US006969290B2

(12) United States Patent
Shaw

(10) Patent No.: US 6,969,290 B2
(45) Date of Patent: Nov. 29, 2005

(54) SPORT BOARD CONTROL DEVICE AND FOOTPIECE

(76) Inventor: Robert Shaw, 157 Sans Rd., Watsonville, CA (US) 95076

( * ) Notice: Subject to any disclaimer, the term of this patent is extended or adjusted under 35 U.S.C. 154(b) by 0 days.

(21) Appl. No.: 10/646,030

(22) Filed: Aug. 22, 2003

(65) Prior Publication Data

US 2004/0235373 A1 Nov. 25, 2004

Related U.S. Application Data

(63) Continuation-in-part of application No. 10/441,610, filed on May 20, 2003, now abandoned.

(51) Int. Cl.[7] ..... B63B 35/79
(52) U.S. Cl. ..... 441/65; 441/74
(58) Field of Search ..... 441/65, 68, 74; 114/39.19

(56) References Cited

U.S. PATENT DOCUMENTS 4,285,082 A 8/1981 Cox
4,645,466 A 2/1987 Ellis
4,924,608 A * 5/1990 Mogonye ..... 36/62
5,454,743 A 10/1995 Simonson
5,766,051 A * 6/1998 Messer ..... 441/65
2003/0056395 A1 * 3/2003 Berggren ..... 36/9 R

OTHER PUBLICATIONS

PCT Search Report, Dec. 10, 1994, Shaw.

* cited by examiner

*Primary Examiner*—Stephen Avila
(74) *Attorney, Agent, or Firm*—Blakely, Sokoloff, Taylor & Zafman; Stephen M. De Klerk

(57) ABSTRACT

A sport board control device and footwear combination, comprising a plurality of foot pads with a plurality of hook and loop grip elements disposed on an upper surface. The foot pads are segmented and positioned on a top surface of a sport board. A plurality of segmented foot pads are spaced on the top surface of the sport board, and have a plurality of hook and loop grip elements disposed on an upper surface. A footpiece formed and configured to fit onto a person's foot and including a substantially planar reinforced sole portion and a plurality of hook and loop fastening elements on a bottom surface, so that the plurality of hook and loop fastening elements may grip to the plurality of foot pads with a plurality of grip elements.

8 Claims, 6 Drawing Sheets

SPORT BOARD CONTROL DEVICE AND FOOTPIECE

PRIORITY CLAIM

This is a continuation-in-part patent application claiming priority to parent application Ser. No. 10/441,610, filed May 20, 2003, now abandoned.

TECHNICAL FIELD

This invention relates to an improved footpiece and control mechanism for sport boards, and more particularly to a sport board and/or bootie useful separately or in combination for improved control and maneuverability of sport boards.

BACKGROUND ART

Various sport boards and accessories have been proposed and implemented for improved ride, control, and enjoyment of surfing, wakeboarding, sand skimming, skateboarding, sail boarding, wake skating, wake surfboarding, and other similar types of board sports using a sport board. Further, both sport boards and accessories have been disclosed and developed with auxiliary devices to hold and position the user on the board. For example, U.S. Pat. No. 4,285,082 issued to Cox, Aug. 25, 1981, discloses a surfboard safety and control accessory using strips of Velcro® or Velcro®-like material on the surfboard, wetsuit, and bootie. But, Cox does not provide enough surface area on the board or bootie to effectively control the board.

Other modifications of sport boards for greater control and maneuverability may be found. For example, in U.S. Pat. No. 4,645,466 issued to Ellis, Feb. 24, 1987, a footpiece with Velcro® or Velcro®-like material is secured to a surfboard and to a bootie. However, Ellis only provides thin strips of Velcro® on the board for attachment to a bootie. Again, these narrow strips positioned linearly with the dimensions of the board do not provide enough surface area or efficient positioning to effectively control the board. In U.S. Pat. No. 5,454,743 issued to Simonson, Oct. 3, 1995, a surfboard is disclosed with ribbed or corrugated side rails for improved strength without an increase in weight. The Simonson surfboard also has a portion of the top surface of the surfboard covered with a layer of unbroken loop nylon material overlying a layer of closed cell foam to form a mat. The Simonson system includes a footpiece with a sole portion having an unbroken loop material for removable attachment to the top surface of the surfboard. Simonson provides two unbroken loop nylon material portions on the top surface of the board. However, these material portions are not segmented for better water channeling and variable levels of adherence at different foot positions. Further, the bootie described in Simonson only has a narrow nylon strip on the sole of the bootie. This narrow strip again does not provide enough surface area to effectively control the board.

Thus, an improved sport board and bootie for better maneuverability and control of a sport board is needed.

SUMMARY OF THE INVENTION

The present invention is a sport board control device and footwear for use separately or in combination allowing for vastly greater control and maneuverability of a sport board. The device and footwear allow far greater pull and push with the user's legs and enhanced ability to perform tricks and to launch the sport board from the ground or the water for aerial maneuvers. The device comprises a plurality of segmented foot pads with a surface of the foot pad being covered at least in part with grip elements. For example, such grip elements can be hook and loop type fastening material (e.g. Velcro®). The footwear comprises a bootie or neoprene foot cover with a substantially flat or planar sole having a plurality of hook and loop fastening elements, such as Velcro®, secured thereto. The combination of the sport board foot pads and the bootie allows the user far greater control of the sport board, prevents slipping on the sport board surface, promotes better safety, and greatly facilitates aerial maneuvers and tricks. The present invention may be provided as a device to modify an existing sport board, or as a sport board which includes the device so it may be used with the foot wear combination. This invention may be used with a variety of different sport boards including, surfboards, wakeboards, skim boards, skateboards, sailboards, wake skates, wake surfboards, and other similar sport boards.

Accordingly, it is the primary object of this invention to provide a device and footwear combination for enhanced control and maneuverability of sport boards. A further object of the invention is to provide a device and footwear combination allowing for greater safety when surfing and to reduce foot slippage on the sport board.

The structure, operation, and advantages of the present invention will be set forth in the description which follows, and in part will be apparent from the description and figures provided herein.

BRIEF DESCRIPTION OF THE DRAWINGS

The accompanying drawings, which are incorporated in and constitute a part of the specification, illustrate various embodiments of the invention and, together with a general description given above and the detailed description of the embodiments given below, serve to enable the practice of the invention.

DETAILED DESCRIPTION OF THE INVENTION

Reference will now be made in detail to the various embodiments of the invention as illustrated in the accompanying drawings.

In accordance with the present invention, there is provided in one embodiment of the invention, a sport board control device and a footpiece, comprising one or more segmented foot pads with an upper surface of each foot pad being covered at least in part with grip elements. For example, the grip elements can be a plurality of hook and loop fastening elements (e.g. Velcro®) disposed on an upper surface of the foot pad. The foot pads may be positioned on a top surface of a sport board by adhesives, plastics, wax, or the like. In one embodiment, the segmented foot pads with grip elements are positioned angularly on said upper surface of the sport board. The angular segmented placement enables better grip of a corresponding footpiece, enables a user to more easily vary the level of adhesion between the board and the footpiece, and enables better channeling of water off of the board. Preferably, the grip elements have a plurality of hook and loop fastening elements (i.e. Velcro®) disposed on an upper surface of the foot pads. The grip elements are positioned on the top surface of the foot pads by adhesives, resins, plastics, wax, or other binding agent. A footpiece or bootie formed and configured to fit onto a person's foot is also provided and includes a substantially planar reinforced sole portion and a plurality of hook and loop fastening elements on a bottom surface of the sole, so that the plurality of hook and loop fastening elements may removably grip to the foot pads and the plurality of grip elements attached thereto.

Figure 1:
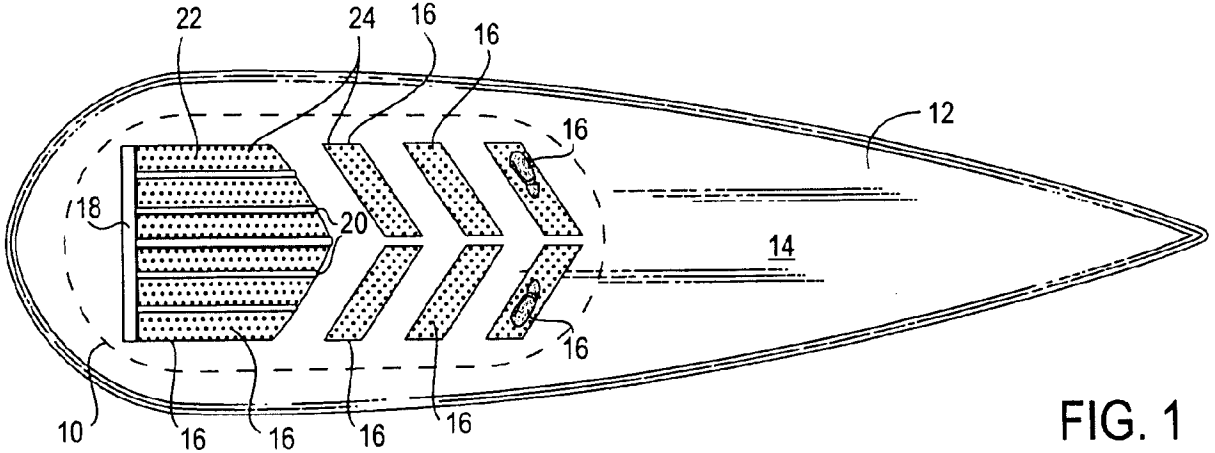
FIG. 1 illustrates a sport board with the sport board control device, according to one embodiment of the invention.
Figure 3:
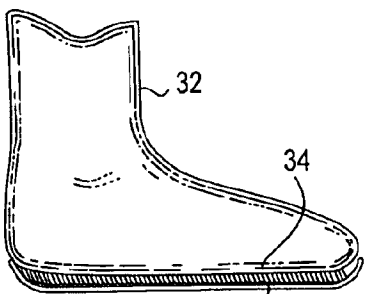
FIG. 3 illustrates the footpiece according to one embodiment of the invention.

In FIG. 1, a sport board control device 10 for enhancing maneuverability and control of a sport board 12, with top surface 14 is shown. FIG. 3 shows the footpiece 32 operable with sport board control device 10. The device 10 may be provided as a sport board with the device 10 and footpiece 32 used in combination therewith, or supplied separately from the sport board 12 so a user could position and affix the device 10 on any chosen sport board.

Figure 2:
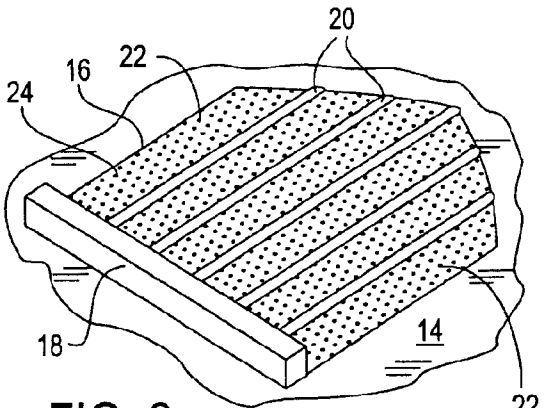
FIG. 2 illustrates an enlargement of a foot pad of one embodiment of the invention.

As seen in FIG. 1, sport board control device 10 preferably comprises a plurality of foot pads 16 having an elevated rear section 18 and a plurality of raised ridges 20 (see detail shown in FIG. 2). However, in alternative embodiments the elevated rear section and the raised ridges may be eliminated. The upper surface 24 of foot pads 16 has affixed thereto a plurality of grip elements, e.g. a plurality of hook and loop fastening elements or Velcro® secured thereon by adhesives, resins, wax, plastics, or other binding agent. Foot pads 16 can be removable from top surface 14 of sport board 12, and may be supplied as part of a sport board or as a separate device that a user can attach to a chosen sport board as desired. However, in alternative embodiments, foot pads 16 may be permanently adhered to sport board 12 if desired by adhesives, resins, plastics or other binding agent.

A plurality of foot pads 10 are positioned and spaced on the top surface 14 of sport board 12. Foot pads 10 each have grip elements affixed on a top surface thereof. The grip elements can be implemented as a plurality of hook and loop fastening elements or Velcro® secured to upper surface 24 by adhesives, resins, wax, plastics, or other binding agent. Foot pads 10 are segmented, spaced, and positioned on top surface 14 as desired, but preferably in proximity to the convenient foot positions of a user of the sport board 12. The foot pads 10 are secured to top surface 14 of sport board 12 using adhesives, resins, wax, plastics, or other binding agent and which may be made removable or permanently attached.

With reference now to FIG. 3, footpiece or bootie 32 formed and configured to fit onto a person's foot and including a substantially planar reinforced sole 34 is shown. The planar reinforced sole facilitates and enhances the grip between footpiece 32 and the grip elements of foot pads 10. Footpiece 32 is provided with a plurality of hook and loop fastening elements 35 or Velcro® on a bottom surface 34 so that the plurality of hook and loop fastening elements 35 removably grip to foot pads 10 with the plurality of grip elements. The plurality of hook and loop fastening elements 35 may be secured to the sole 34 of footpiece or bootie 32 by adhesives, resins, heat, or other binding agent.

In FIG. 2, foot pad 16 is shown uninstalled on a sport board. Foot pad 16 may optionally have an elevated rear section 18 with a plurality of raised ridges 20. But the elevated rear section and raised ridges are not necessary to the present invention. Hook and loop fastening elements 22 or Velcro® is placed on the upper surface 24. These fastening elements grip and adhere to the hook and loop fastening elements 35 of footpiece 32.

Figure 4:
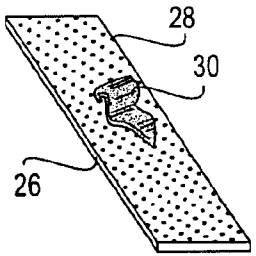
FIG. 4 illustrates a grip element of the foot pad according to one embodiment of the invention.

In FIG. 4, a foot pad 26 is shown with upper surface 28 and hook and loop grip elements 30 or Velcro® adhered to upper surface 28. One or more foot pads 26 with grip elements may be positioned and attached to the upper surface of a sport board by adhesives, resins, wax, plastics, or other binding agent, and spaced at a desired distance chosen for a user of a particular sport board.

In operation and use, sport board control device 10 and footpiece 32 in combination, is very efficient and reliable, for securing, enhancing and greatly increasing the ability to control and maneuver a sport board. The present invention may be provided as a sport board which includes foot pads 10 with grip elements. Footpiece 32 is used in combination with such a sport board. Alternatively, foot pads 10 with grip elements and footpiece 32 may be sold separately from a sport board, so a user could simply apply the foot pads 10 with the grip elements to a chosen board by adhesives, resins, wax, or other binding agent. Or the foot pads 10 with grip elements may be sold with a binding layer of adhesives or the like pre-applied thereto.

Figure 5:
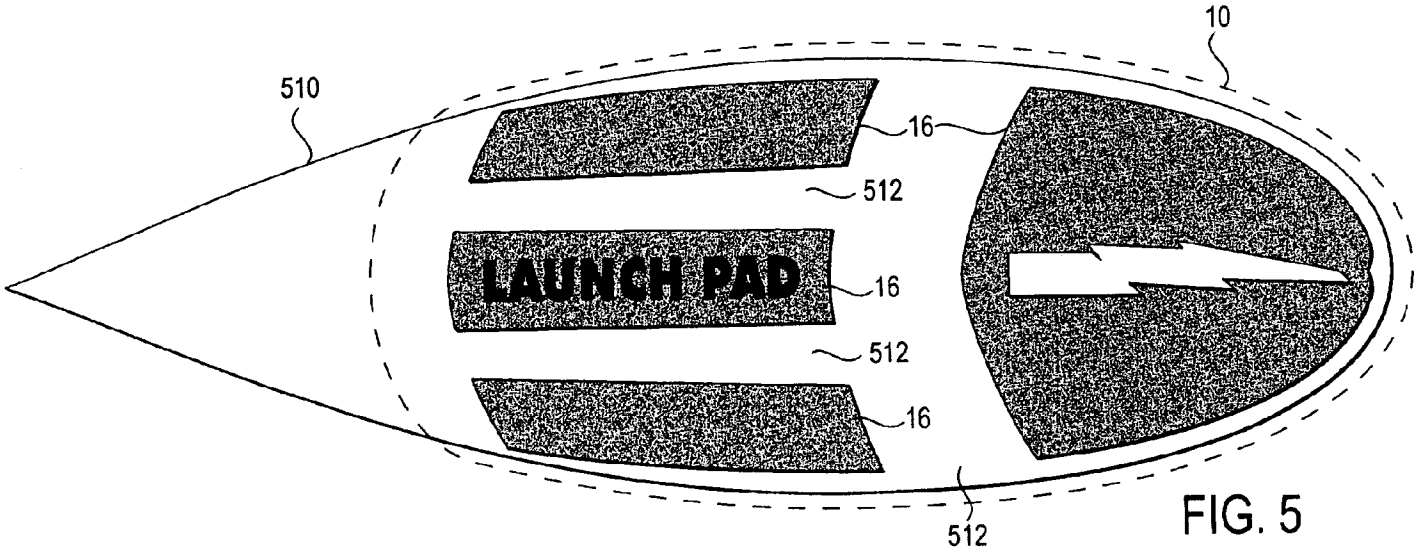
FIG. 5 illustrates an alternative embodiment of the present invention.
Figure 6:
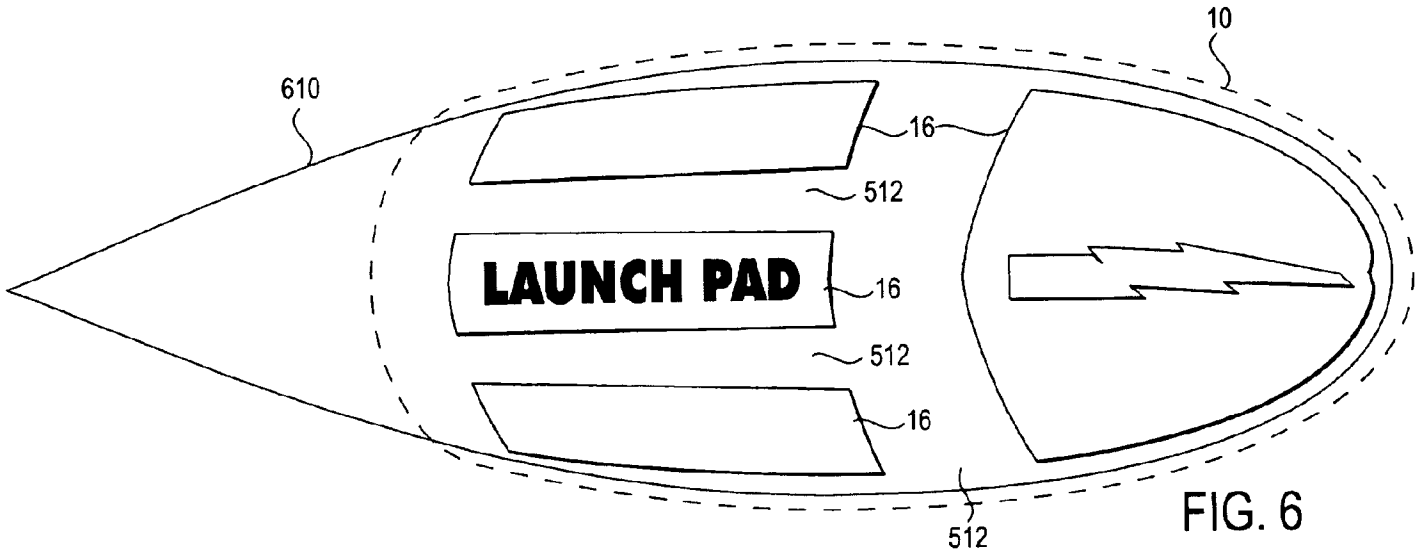
FIG. 6 illustrates an alternative embodiment of the present invention.
Figure 7:
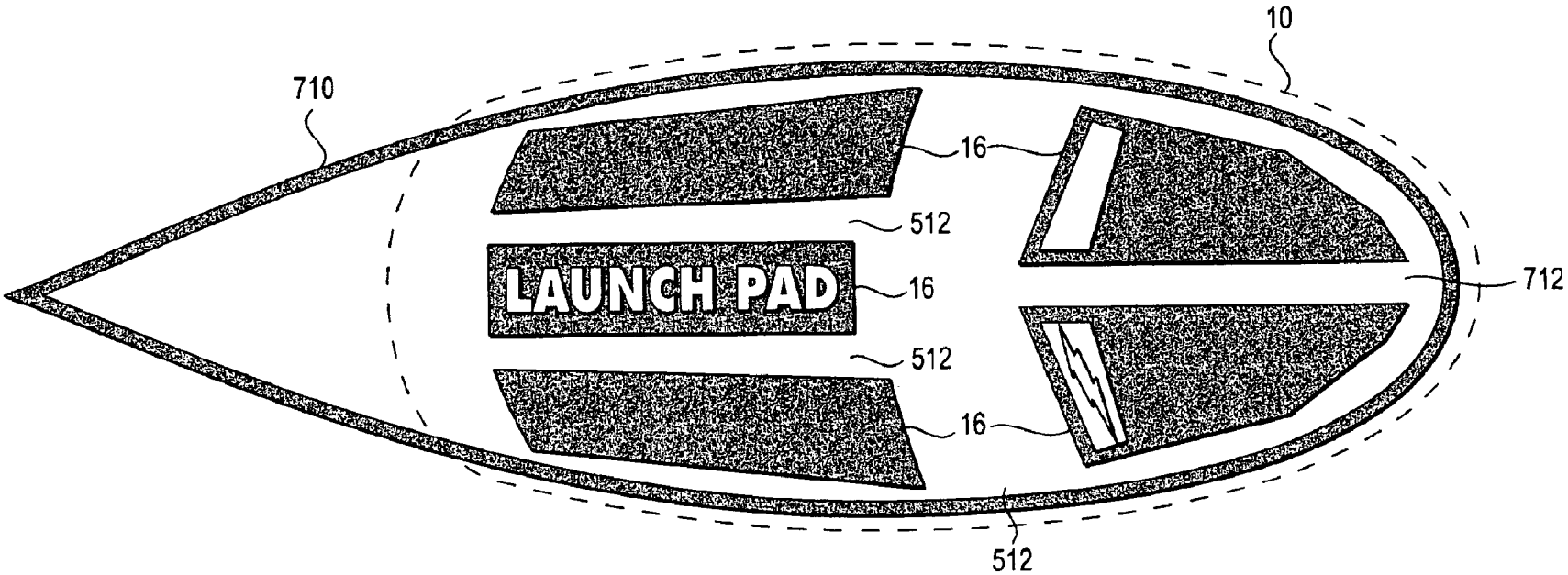
FIG. 7 illustrates an alternative embodiment of the present invention.
Figure 8:
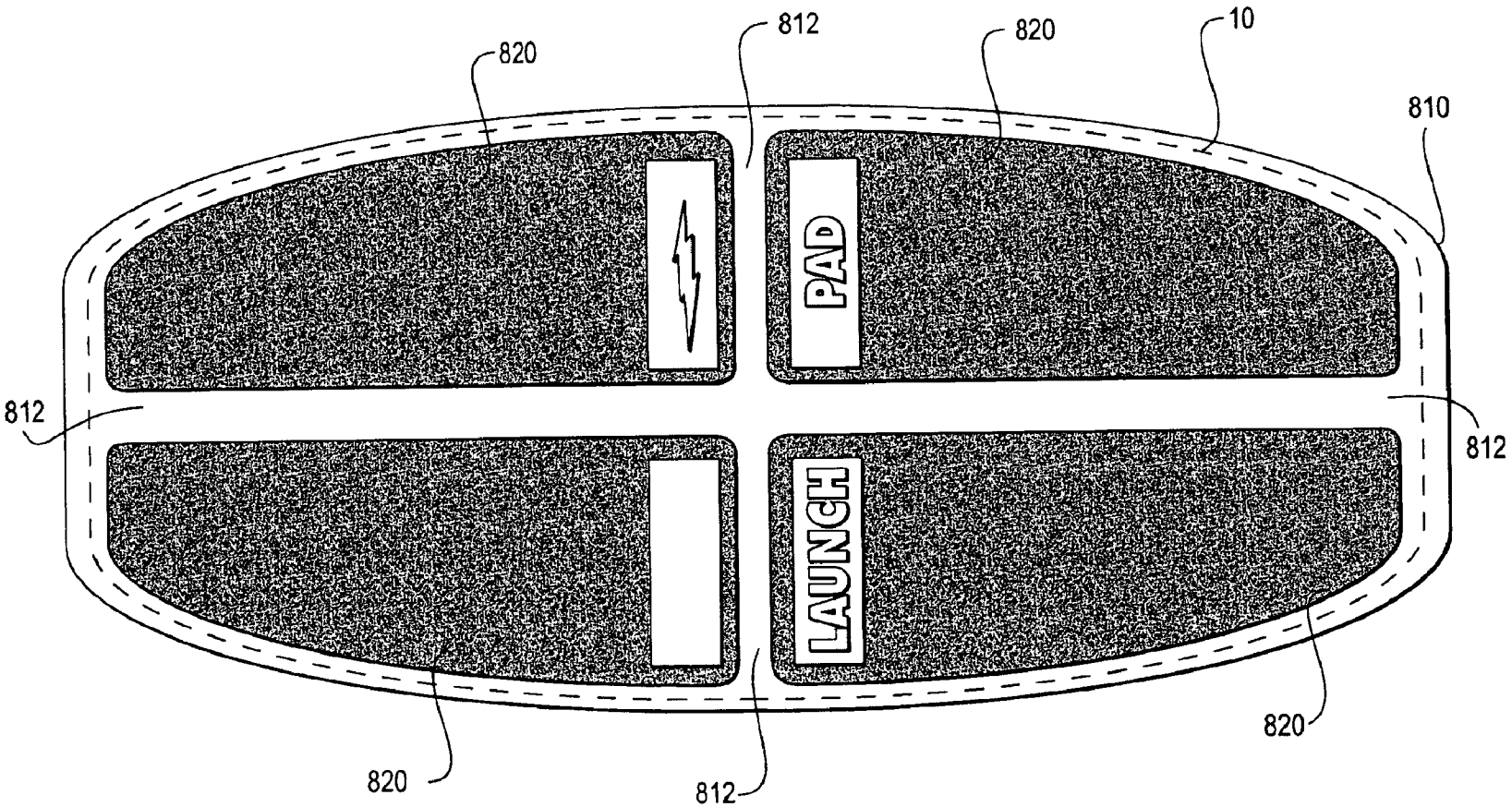
FIG. 8 illustrates an alternative embodiment of the present invention.

Referring to FIGS. 5 through 8, various embodiments of the present invention are illustrated. For example, in FIG. 5, the sport board control device 10 including a plurality of foot pads 16 is shown as attached to a sport board 510. Similarly, as shown in FIG. 6, a somewhat different embodiment of the foot pads 16 is shown on sport board 610. In each of the embodiments illustrated in FIGS. 5 and 6, the foot pads 16 are segmented on sport boards 510 and 610. This segmentation creates gaps 512 between the segments of the foot pads 16 where there is no grip element present in gaps 512. Gaps 512 between foot pad segments are advantageous for several reasons. First, the gaps provide a way for the sport board control device 10 to be installed on sport boards of varying dimension. Thus, the gaps 512 can be widened or narrowed depending on the size of sport board 510. Secondly, the gaps 512 between segmented foot pads 16 provide a way for a user to vary the level of adhesion that the user experiences when the user steps down on sport board 510 while wearing a bootie 32. For example, if a user steps completely onto one of the foot pads 16, the level of adhesion to sport board 510 will be high. Conversely, if a user steps completely or partially into one of the gaps 512, the level of adhesion will be low, because no grip elements are present in gaps 512. Thus, the user can vary the level of adhesion by determining where he or she steps onto the sport board control device 10. Thirdly, gaps 512 provide a means for channeling water from the front portion of board 510 to the rear portion of board 510 thereby conveniently removing excess water from the surface of sport board 510. This effect can be enhanced by the angular placement of foot pads 16 onto sport board 510 relative to the longitudinal dimension of sport board 510. Thus, as shown in FIGS. 5 through 7, the center foot pad 16 is placed at a position slightly closer to the front of sport boards 510, 610, and 710 and the outboard foot pads are placed slightly toward the aft end of sport boards 510, 610, and 710. As a further example, FIG. 1 illustrates a slightly different angular placement of the segmented foot pads 16. As shown in FIG. 7, the aft foot pad 16 is further segmented to produce gap 712, which provides the advantages described above. FIGS. 5, 6, and 7 illustrate various embodiments of the present invention as may be used in combination with a surfboard, a sailboard, or a wake surfboard. Referring now to FIG. 8, an embodiment of the present invention is illustrated as may be used with a skateboard, a wakeboard, a wake skate, a sand skimming board, or other type of sport board. As show in FIG. 8, the sport board control device 10 is shown as attached to sport board 810. Again, sport control device 10 includes a plurality of segmented foot pads 820 arranged on sport board 810 with gaps 812 there between. As described above, the segmented foot pads enable certain advantages not provided by conventional technology. Also as described above, each of the foot pads 820 include grip elements attached thereon which may be used in combination with a bootie 32 including corresponding fastening elements attached to a sole thereof. As described above, a user of sport board 810 may position his or her foot on the foot pads 820 of sport board 810 in a manner to establish a level of control over the maneuvering of sport board 810. Unlike the surfboard and wake surfboard configurations illustrated in FIGS. 5 through 7, as shown in FIG. 8, the foot pads 820 cover a substantial portion of the top surface of sport board 810 including the portions toward each end of sport board 810. As such, the configuration of foot pads 820 in the embodiment illustrated in FIG. 8 provides a user with greater mobility and positioning over a larger dimension of the top surface of sport board 810. In this manner, the user of sport board 810 can achieve a high degree of control by being able to position his or her foot almost anywhere on the top surface of sport board 810. By use of a bootie 32 such as the one illustrated in FIG. 3 and described above, the user can removably attach his or her feet to the foot pads 820 of the top surface of sport board 810.

Figure 9:
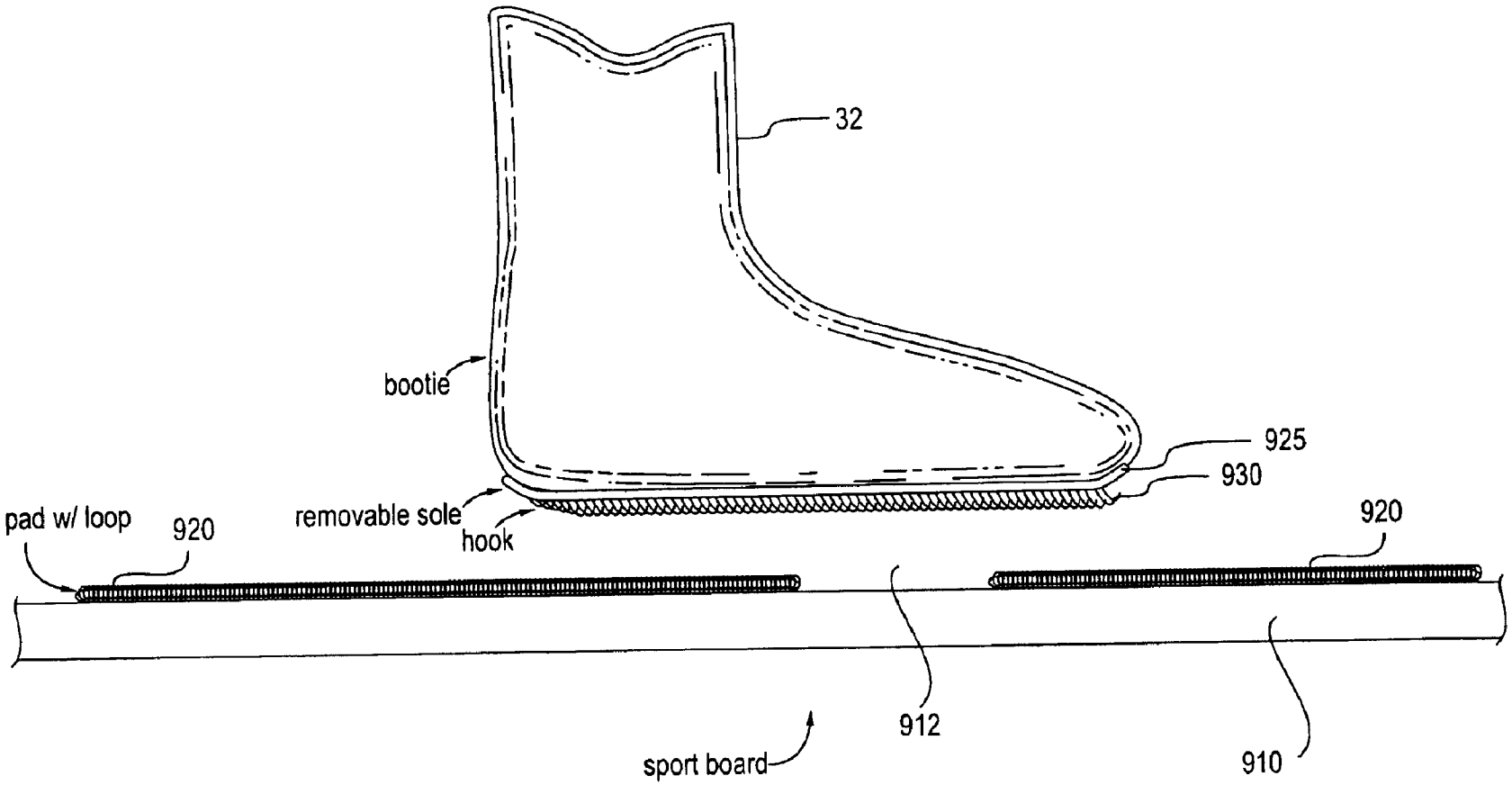
FIG. 9 illustrates an embodiment of the footpiece of the present invention.

Referring now to FIG. 9, an embodiment of the bootie 32 is illustrated. Bootie 32 in one embodiment includes a removable sole 925 to which fastening elements 930 such as hook and loop fasteners or Velcro® are attached. In one embodiment, removable sole 925 with fastening elements 930 may be permanently attached to the sole of bootie 32, or removable sole 925 with fastening elements 930 may be removably attached to the sole of bootie 32 using conventional adhesives or bonding agents. In contrast to many prior art implementations, the removable sole 925 with fastening elements 930 cover substantially the entire bottom surface of the sole of bootie 32. This larger extent of coverage on the sole of bootie 32 enables a greater degree of adhesion of bootie 32 to the grip elements of foot pads 920 shown attached to sport board 910 in FIG. 9. Note also as shown in FIG. 9 that the gap 912 between foot pads 920 provides a void where no adhesion by the grip elements of foot pads 920 is provided. In this manner, the user may vary the level of adhesion of bootie 32 to the foot pads 920 on sport board 910.

Figure 10:
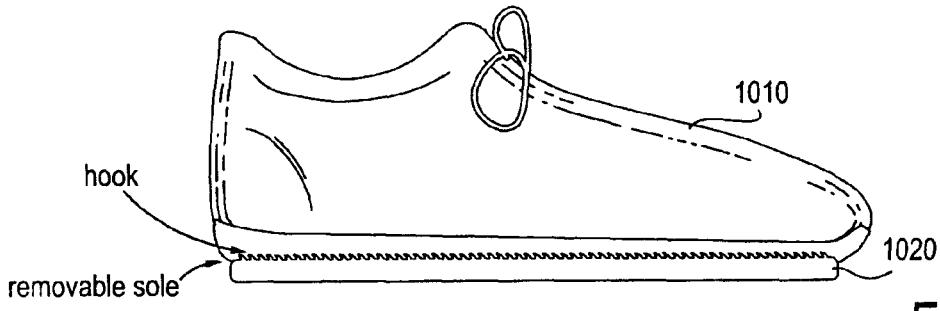
FIG. 10 illustrates an embodiment of the removable sole of the present invention.
Figure 11:
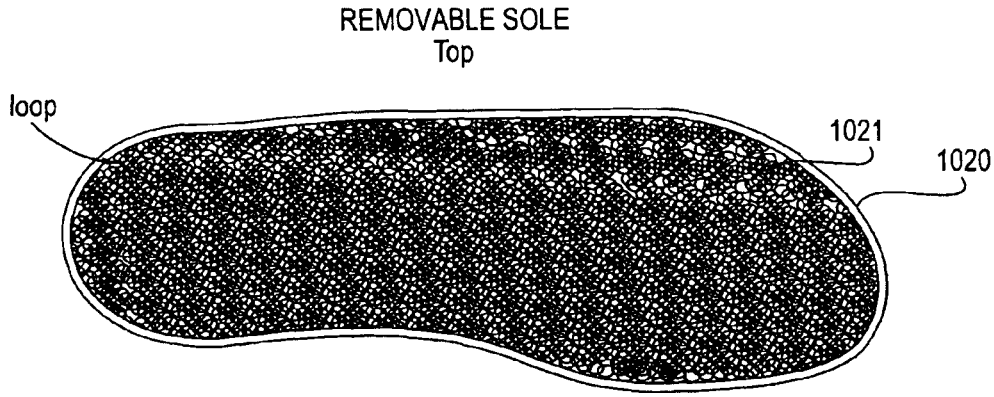
FIG. 11 illustrates an embodiment of the removable sole of the present invention.
Figure 12:
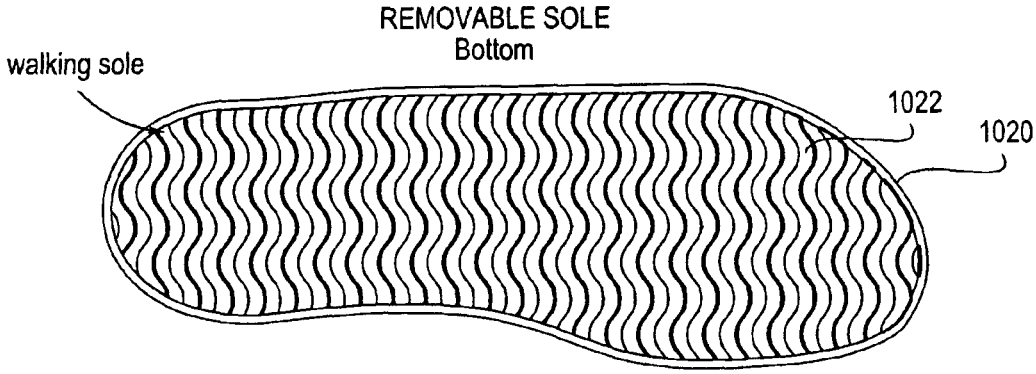
FIG. 12 illustrates an embodiment of the removable sole of the present invention.

Referring now to FIGS. 10, 11, and 12, a footpiece or shoe 1010 is shown with a removable sole 1020. Removable sole 1020 provides a means for converting a bootie, a footpiece 32 such as the one shown in FIG. 9 from a footpiece having fastening elements 930 on the bottom sole to a footpiece with a walking sole on the bottom. In this manner, the footpiece 32 suitable for use with the grip elements 920 on a sport board can be conveniently converted to a footpiece 1010 suitable for walking on pavement or other surface different from the grip element surface of a sport board. As shown in FIGS. 11 and 12, the removable sole 1020 on a top side has fastening elements affixed over the entirety of the surface thereof. These fastening elements cooperate with the corresponding fastening elements 930 on the bottom of a footpiece 32 such as the one shown in FIG. 9. In this manner, removable sole 1020 can be removably affixed to the fastening elements 930 on the bottom of footpiece 32. As shown in FIG. 12, the bottom side of removable sole 1020 is a conventional walking sole, such as might be present on any conventional walking shoe or conventional tennis shoe. Such a walking sole may be a rubber or other conventional surface for providing suitable friction on pavement, sidewalk, or other conventional surfaces. Thus, removable sole 1020 provides a convenient means for converting a footpiece 32 for use with the sport board control device 10 of the present invention to a conventional walking shoe.

In an alternative embodiment, the footpiece 1010 can be created with a recessed sole. In this manner, the removable sole 1020 can fit within the recess of footpiece 1010, which thereby provides an outer edge around the entire perimeter of removable sole 1020. The recess of footpiece 1010 allows the removable sole 1020 to be essentially hidden from view as footpiece 1010 is viewed from the side.

In another alternative embodiment, a package of materials is provided, which includes patch, a portion of adhesive, and an applicator. The patch is configured with gripping elements on one side and shaped to conform to the shape of the sole of a conventional footpiece, such as a shoe or a bootie. The patch could be cut to fit if necessary. The kit can be used to apply adhesive using the applicator to the side of the patch without the gripping elements. The patch with the adhesive is then applied to the sole of a conventional shoe or bootie, thereby converting the shoe or bootie to a footpiece useable with the footpads of a sport board as described above.

In a similar manner, a removable pad may be implemented for removable attachment to the grip elements on the top surface of foot pads 16 as part of the sport board control device 10. The removable pad has, in similar fashion to removable sole 1020, one side covered with fastening elements for attachment to the grip elements of foot pads 16. The reverse side of the pad has a rubber or similar surface as may be suitable for use with their feet. In this manner, a sport board with the sport board control device 10 attached thereto may be conveniently converted to a sport board with a non-adhesive rubber top surface for use without a bootie 32 with a Velcro® sole.

Additional advantages and modification will readily occur to those of ordinary skill in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A system comprising:

a footpiece formed to fit onto a foot of a user, the footpiece having a bottom surface;

a first fastening element attached to the bottom surface of the footpiece;

a sport board having a top surface;

a second fastening element attached to the top surface of the sport board, the second fastening element shaped to cooperate with the first fastening element to removably affix the bottom surface of the footpiece to the top surface of the sport board;

a removable sole having an upper and a lower surface; and a third fastening element attached to the upper surface of the removable sole, the third fastening element shaped to cooperate with the first fastening element to removably affix the removable sole to the bottom surface of the footpiece.

2. The system of claim 1, wherein the first, second, and third fastening elements are at least one of a plurality of hook fasteners and a plurality of loop fasteners.

3. The system of claim 2, wherein the first fastening element is a plurality of hook fasteners and the second and third fastening elements are a plurality of loop fasteners.

4. The system of claim 3, wherein the loop fasteners on the top surface of the sport board are divided into a first foot pad and a second foot pad with a gap between the first and second foot pads.

5. The system of claim 4, wherein the bottom surface of the footpiece is of a material that provides suitable friction on pavement, a sidewalk, or other conventional walking surfaces for walking.

6. The system of claim 5, wherein the footpiece includes a lace attached thereto to adjust the fit of the footpiece on the user's foot.

7. The system of claim 6, wherein the removable sole comprises rubber.

8. The system of claim 7, wherein the sport board is at least one of a surfboard, wakeboard, skim board, skateboard, sailboard, wake skate, and wake surfboard.

* * * * *